United States Patent [19]

Maine et al.

[11] Patent Number: 4,700,181

[45] Date of Patent: Oct. 13, 1987

[54] GRAPHICS DISPLAY SYSTEM

[75] Inventors: Stephen Maine; Duncan Harrower, both of Fort Salonga; Abraham Mammen, Levittown, all of N.Y.

[73] Assignee: Computer Graphics Laboratories, Inc., New York, N.Y.

[21] Appl. No.: 537,972

[22] Filed: Sep. 30, 1983

[51] Int. Cl.[4] ..... G09G 1/16

[52] U.S. Cl. ..... 340/747; 340/724; 340/750

[58] Field of Search ..... 340/703, 726, 724, 723, 340/747, 750

[56] References Cited

U.S. PATENT DOCUMENTS

| | | | |
|---|---|---|---|
| 3,833,760 | 9/1974 | Tickle | 340/747 |
| 4,075,620 | 2/1978 | Passavant . | |
| 4,189,743 | 2/1980 | Schure et al. | 340/725 |
| 4,189,744 | 2/1980 | Stern | 340/725 |
| 4,209,832 | 6/1980 | Gilham et al. | 340/747 |
| 4,232,311 | 11/1980 | Agneta | 340/703 |
| 4,317,114 | 2/1982 | Walker | 340/747 |
| 4,384,338 | 5/1983 | Bennett | 340/729 |
| 4,404,554 | 9/1983 | Tweedy, Jr. et al. | 340/726 |
| 4,412,294 | 10/1983 | Watts et al. | 340/726 |
| 4,437,093 | 3/1984 | Bradley | 340/726 |
| 4,439,760 | 3/1984 | Fleming | 340/747 |
| 4,459,677 | 7/1984 | Porter et al. | 340/750 |
| 4,554,538 | 11/1985 | Bieneman | 340/747 |
| 4,555,775 | 11/1985 | Pike | 340/747 |
| 4,611,202 | 9/1986 | DeNitto et al. | 340/724 |

FOREIGN PATENT DOCUMENTS

| | | |
|---|---|---|
| 67302 | 12/1982 | European Pat. Off. . |
| 60117327 | 11/1983 | Japan . |

OTHER PUBLICATIONS

*Microcomputer Displays, Graphics & Animation;* Artwick Prentice-Hall; 1985; pp. 280-287.

*Computer Recreations,* Dewdney, Scientific American, Jul., 1986; pp. 16, 18, 22-24 and 120.

"Computer Graphics", Electronic Design, 1/20/83, p. 75.

"Computer Graphics—Better Graphics Opens New Windows on CEA Stations", M. Schindler, Electronic Design, 1/20/83, pp. 77-82, 84, 86.

"Computer Graphics—Silicon Support For Video Displays Grows Smarter", D. Bursky, Electronic Design, 1/20/83, pp. 93-98.

"Computer Graphics—Graphics Standards Are Emerging, Slowly but Surely", C. Bailey, Electronic Design, 1/20/83, pp. 103-108, 110.

"Computer Graphics—Dedicated VLSI Chip Lightens Graphics Display Design Load", G. DePalma et al., Electronic Design, 1/20/83, pp. 131-136, 138, 139.

"Computer Graphics—μP Architecture Suits Bit--Mapped Graphics", P. Chu et al., Electronic Design, 1/20/83, pp. 143-148, 150, 152.

"Computer-Graphics—CRT Controller Chip Displays High Quality Attributes", B. Cayton et al., Electronic Design, 1/20/83, pp. 157-163.

"Computer Graphics—Graphics Frees Itself from Device Dependence", B. Perry, Electronic Design, 1/20/83, pp. 167-173.

"Computer Graphics—Focus on Graphics Terminals: VLSI Raises Performance", C. Warren, Electronic Design, 1/20/83, pp. 183, 184, 188-190, 192.

*Primary Examiner*—Marshall M. Curtis

*Attorney, Agent, or Firm*—Martin M. Novack

[57] ABSTRACT

A system for the storage, retrieval and manipulation of data for producing a display, in which inter alia, color availability is in the form of appropriately pre-selected palettes, three-dimensional or planar objects are composed of patterns or elements which are individually stored, the display image is made up in buffers which alternate as construction and display buffers by data accessed in memory by lists linking them in ascending order of visible priority, the data then being written into the buffers, the nature of the data storage varying in predetermined fashion for different types of objects, all so that highly complex and visually pleasing graphics can be displayed and manipulated within the time constraint of a full motion video raster scanning system.

29 Claims, 31 Drawing Figures

FIG.6a
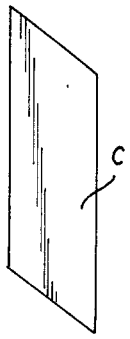
FIG.6b
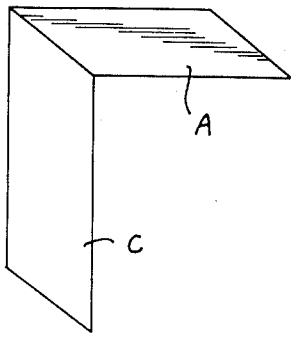
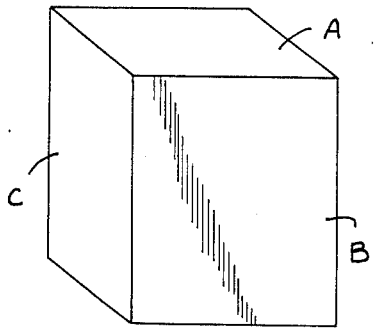
FIG.6c
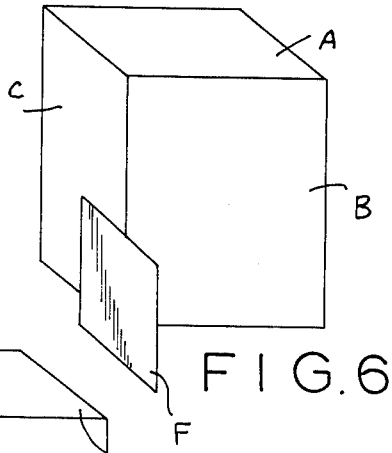
FIG.6d
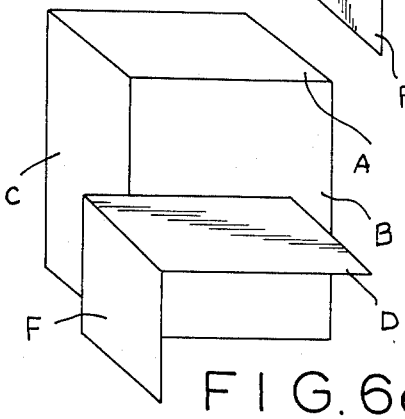
FIG.6e
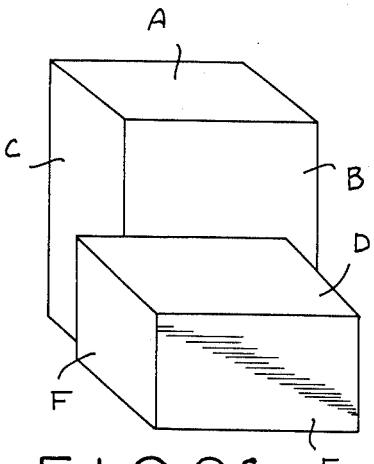
FIG.6f
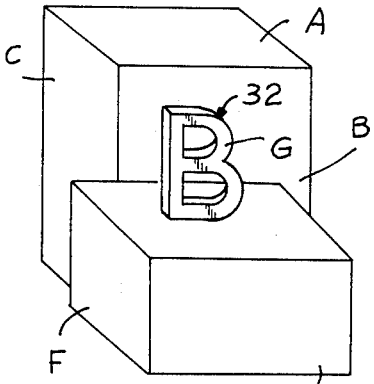
FIG.6g

| | | | | | | |
|---|---|---|---|---|---|---|
| 0000 H | DISP_SEG (4) | EXTRN VIDEO TRAP (8) | SCT | LPN | EXV | SRS |
| 0001 H | ROW LIST POINTER (16) | | | | | |
| 0002 H | PALETTE UPDATE MASK (16) | | | | | |
| 0003 H | COLORMAP BASE POINTER (16) | | | | | |
| 0004 H | INTERRUPT ACTIVATION COUNT (8) | Y ORIGIN (8) | | | | |
| 0005 H | X ORIGIN (10) | | | | | |
| 0006 H | SLICE LIST POINTER (16) | | | | | |

| | |
|---|---|
| HEIGHT OF ROW (8) (HOR) | TOP OF ROW (8) (TOR) |
| PALETTE UPDATE MASK (16) | |
| BACKGROUND WINDOW LIST POINTER (16) | |
| LINK TO NEXT ROW (ROW_LNK) (16) | |

FIG.17
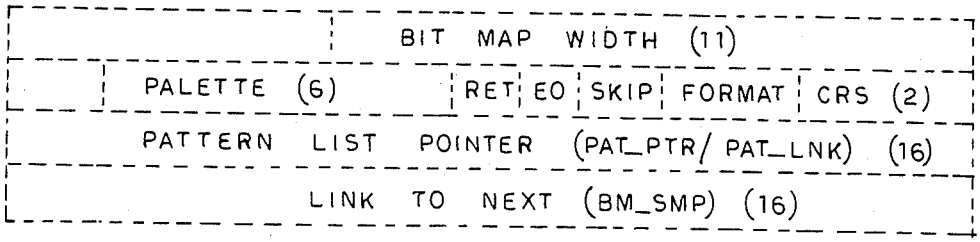
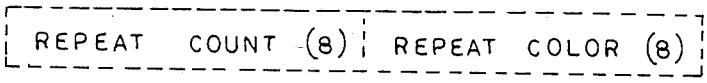
FIG.18
FIG.19
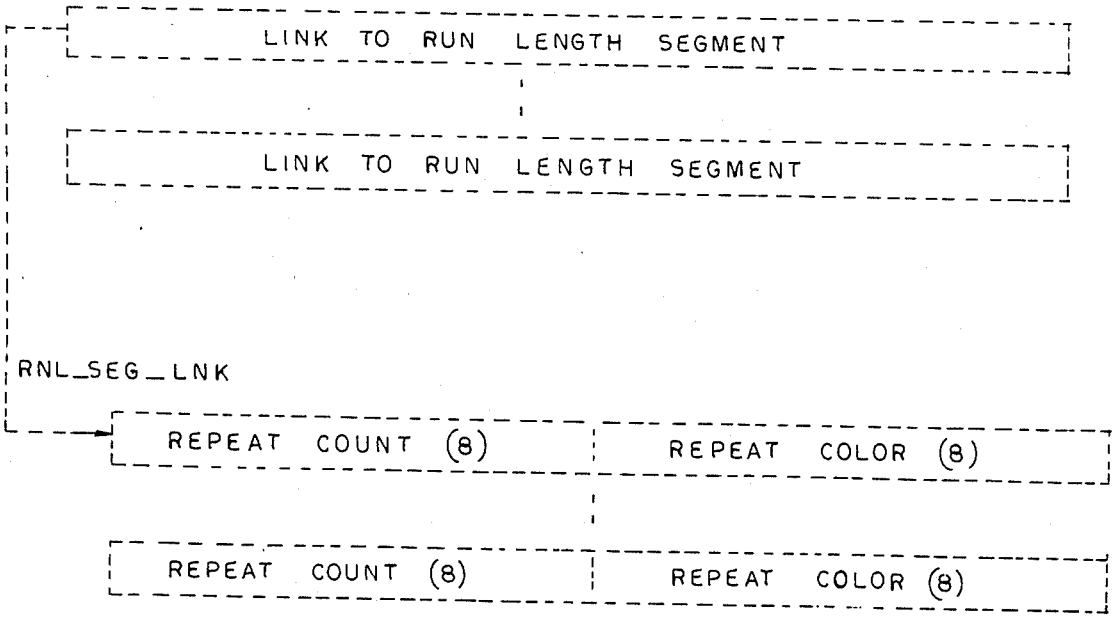

GRAPHICS DISPLAY SYSTEM

BACKGROUND OF THE INVENTION

The existing architectures of personal home computers and video games provide graphics performance which is severely limited due to technological restrictions imposed when the designs were developed. In the late 1970's, most graphics systems being designed used either 8 bit microprocessors or low performance 16 bit machines. By today's requirements, graphic processors of that time were mediocre in terms of resolution, color definition and animation support. The memory speed of these machines was insufficient for the high bandwidth encountered in the video domain. These and other restrictions caused the graphic display systems to be deliberately compromised.

The simplest approach to minimize bandwidth and memory requirement is to implement a "card" approach. This approach segments the screen into a matrix of small rectangles. Each rectangle may accept a simple outline pattern filled with a single color to represent a primitive object. This approach gives satisfactory representation of an image perceived in two dimensions. However, the realism of an image is related to perception in three dimensions. Moreover, the basic single color card approach introduces severe handicaps when one attempts to portray overlapped or merged images.

A second approach taken to graphics systems has been to employ a one to one correspondence between system memory and usable screen positions. This technique is referred to as bit map or pixel (picture element) map. Unfortunately, the bit map approach has restrictions of its own. The image quality becomes unacceptable if the memory is minimized to remain within cost and speed constraints. Even if sufficient memory is provided, older processors cannot create the images fast enough to support animation.

In consideration of these problems, hybrid systems were created which provided unit screen bit map representation of a single "card" position. In this development bit map card approaches (still small rectangles) were joined with the notion of object independence, which allowed objects to be placed randomly around the screen and overlayed on top of each other. This concept aided in the generation of multiple planes containing objects to support three dimensional effects (which are rudimentary compared to the effects obtainable by the system here disclosed). While these innovative hybrids spawned an explosive business in programmable T.V. games, they are not easily enhanced, thus restricting their further use. To sustain personal computers and other graphics terminals throughout the late 1980's, more advanced and flexible architectures must be created.

The software environment available in most graphic system architectures assembles characters and patterns in a simple sequential list organization. This format, although easy to implement, is quite cumbersome and ineffective in environments which are constantly being modified, updated and destroyed such as in image construction and animation. Systems currently do not provide enough capability to support commonly encountered data structures that are used within a typical data base or programming environment. The reorganization of the sequential data pattern is essential for future generation graphic systems.

The Application Impact Of This Invention

The enhanced capability of the system of the present invention significantly expands the potentialities of a graphics system, particularly in terms of manipulation of data in order to create a scene and change it, all within the time constraint of a full motion video display system such as a CRT monitor or a TV set.

By way of example, it makes remote merchandising more appealing to chain stores. The so called "shop in shop" terminal frees a store owner from the burden of maintaining inventory on all of the items he seeks to sell. The shopper would go to the store and view items he might like to purchase on a television screen. Sitting at a terminal, he would define what he wanted to look at by category or item and the system will display all the appropriate merchandise on the screen. Should the shopper wish to purchase an item, he would place an order for it through the terminal. The item would be sent to his home, along with a bill (much like the mail order catalog of today). An approach having the high resolution/low cost ability of this system is required to make this type of merchandising useful and popular.

This technology will also bring low cost graphics to advertising and design companies. At present, these companies are forced to use costly computer graphics techniques, or, if not, costly conventional graphic techniques. This system permits the creation of realistic images, including animation, in a fraction of the time currently required.

Similarly, this system provides a new forum for engineering design and execution. The Graphics Pre-Processor allows engineers to design in much the same way as present computer-aided design systems, but with a greater color flexibility. The entire system is useful in computer aided manufacturing for design rule control, ensuring, for example, that parts of a designed chip will not touch and short out during manufacture.

Moreover, and very importantly, the system brings new prospects to real time simulation and computer gaming. Military training and design testing is greatly enhanced by the high resolution images. The simulations offer a much more realistic experience than is currently possible. The same is true for education. Simulation also overlaps into computer gaming as the system provides more definition, color, and weight to objects that appear typically lifeless in current arcade and home games. There is a demand for more realistic experiences as home computers and television monitor resolution improve and this system is particularly well adapted to meet that demand.

The Instant System

The computer graphics system of the present invention allows the user to manipulate complex realistic images in real time. As used in this specification and in the claims, "real time" refers to the time required by a full motion video display system, such as one meeting standards of the National Television Standards Committee, to provide commercially acceptable representations of motion. Typical of such display systems are CRT monitors, TV receivers and the like. The system of the present invention produces instant interactive images within the time required to scan a frame of the display system, and can sustain those images indefinitely. Thus, designed with speed in mind, this system is capable of producing life-like animation for the domestic television set or monitors. This animation can be made up of entirely computer generated shapes or pictures scanned into the host computer with a video camera. In either case, the resolution 30 provided is far better than what current low cost computer video systems provide.

This speed and resolution is derived from the way information is stored, retrieved and allocated. Because of basic assumptions about the way users compose images, the system can output a tremendous amount of data within a short amount of time. Over 9 million pixels per second can be changed as images are constructed out of basic, externally stored shapes.

The system is broken down into seven basic components, four implemented in hardware and three implemented by software. In terms of hardware, the system utilizes a graphics preprocessor, an image management processor, a system processor and a graphics post processor. Each processor may be a separate specially designed chip.

The graphics pre-processor performs the necessary mathematical computations to enable one to scale objects up or down, and to let one rotate objects. The system processor, which may be conceptualized as part of the software, is a microprocessor which translates the software instructions into commands appropriate to the hardware system. Also, it lets one move an object from one position to another. It performs the task of constructing and managing the linked list prestructure, which linked list operates as the run time object code for the image management processor. The image management processor creates complex graphic images using object definitions that exist as files in the host system's memory. It takes the commands that the system processor and the graphics pre-processor constructed and executes them in real time so that animation produced is far more realistic than standard video games. The graphics post processor takes the output from the image management processor and from that output enables the display of an image of enhanced quality on a domestic television set receiver or low cost monitor.

A key to this real time operation is the assembly of picture information within the time constraints of the raster scanning process. On a line-by-line basis for commercial television, for example, the system has only 64 microseconds to put information on a scan line before it is displayed. Speed is essential.

In terms of software, the system utilizes a linked-list data structure, image encoding and image decimation to support the hardware. The linked-list data structure, a hierarchy or tree-like structure with links representing references to other points in the tree, makes the construction of images from basic, externally stored objects, or shapes (such as geometric and non-geometric images), more straightforward than the traditional sequential structure approach. Objects need only be referenced in the input stream to the image management processor by their location in external memory. When an object pattern is needed, it is retrieved from that memory. One may have, therefore, only one copy of the object stored, but can use it in more than one place in a picture. Linked-lists also allow for easy insertion or deletion of objects in a partially completed picture.

The encoding of images makes it possible for the system to store more object patterns in its available memory for use in image composition. Without encoding, an object would be stored as an array of binary numbers, indicating what color value should be painted at each corresponding pixel to display the object. Encoding permits the object be stored as instructions, which indicate what color value to paint over a range of pixels in order to display the object. Encoding improves efficiency by considering the shape of an object, whereas standard storage techniques do not.

The decimation of an image makes it possible to perceive a high resolution image on a television set of lower resolution.

With these seven basic components, the system can be used for a broad range of graphics applications.

An important overall aspect of the instant system is the traversal and execution of instructions represented as a linked list implemented in hardware for the purpose of creating displays on CRT monitors, TV receivers and the like in real time. The linked lists themselves define, and are created in terms of, the relative visible priorities of the various objects displayed. The objects to be displayed, and their attributes, are stored in memory in totally arbitrary locations.

Another important aspect of the system is that while the user has absolute access to 4096 colors, he will not need to have access to all of those colors all of the time. For example, he may only need to use 256 colors on any one scan line, and either 4, 16 or 256 at any one instant. The system recognizes that it is unnecessary and inefficient to have more colors on hand than you really need at one time. The system supports the arbitrary grouping of colors into palettes, and the use of a limited number of such palettes, all controlled by the user for each individual display application.

The heart of the system software is a linked list structure. This list, used in novel ways, gives the system the speed needed to provide the user with real time animation. Other integral parts of the system that interact with the linked list are character data, bit maps, display buffers and picture components.

The linked list tree-like data structure allows for dynamic storage which gives the system more flexibility and increases its speed. The conventional sequential array structure wastes time doing insertions and deletions due to the fact that all the data below the insertion or deletion must be moved in the array. Movement of all this data makes real time implementations impossible. By contrast, the use of linked lists to store and manipulate data allows the memory to be accessed and filled with data as it is needed, and at a speed which enables the system to produce real time image assembly. This increase in speed occurs because the only thing that changes in the data structure is a pointer to a group (record) of data (a node). Moreover, by changing only one value in a node (the value of the pointer) a picture can be drawn in various positions. This allows the system to overlay images in the positive z - plane.

In the instant system a "script" for the display is "written" in real time by creating the appropriate linked list. Thereafter, also in real time, the "script" is "read" by executing the linked list and inserting the appropriate data into buffer storage. These "writing" and "reading" steps are carried out asynchronously relative to the display system. Thereafter the "script" is "enacted" or "painted" by "reading" the buffer storage into the display device synchronously with the display device cycle.

Three-dimensional objects can be quite realistically displayed by controlling the shading or luminance of different contours of the objects, which task is greatly facilitated, in terms of speed and equipment cost, by use of the palette approaches previously discussed.

In the form here specifically disclosed, the graphics display line by line, conforming to the way an image is produced on a conventional raster scan display. (It will be understood that the use of a one-line buffer is disclosed only by way of example. The buffer could comprise any number of lines, even up to an entire frame. Single line buffers require less hardware than multiple line buffers, but are somewhat more time-sensitive than, for example, complete frame buffers.) Each line to be displayed is formed by using linked lists to retrieve from memory the data required for that line, and writing that data into a temporary memory, or buffer. Such a buffer is a bit map which holds enough information for one scan line (1 Pixel high by 640 Pixels wide).

Conceptually, a line buffer is a matrix in memory 640 bits long by 8 bits deep. The system makes use of two line buffers. One buffer displays a scan line while the other buffer is constructing the image for the next scan line. This use of two buffers allows the system to perform real time animated graphics.

The pictures in the system are loaded into a line buffer by overlaying objects on top of each other in the positive z - plane. This is analogous to the way that an artist approaches a blank piece of canvas. First he paints in the background and the sky and progressively, he puts the more detailed foreground objects on top of the background objects. In the system, the background objects and foreground objects are connected to each other by linked lists. The system reads down the links in the list and loads the information from the first background object into the line buffer. It then proceeds to the next node and writes on the same line buffer in any location where this image will appear in this row. In this way, objects are continually overlayed so that foreground objects completely cover the background objects that were originally in their location on the screen. When the overlay procedure is complete, the line buffer is ready to be sent to the screen.

The system utilizes additional approaches to the storage, arrangement and handling of data relating to various aspects of the scene to be displayed which greatly facilitate a translation of that data into actual display pictures in real time. In the first place, the graphics data is subdivided into "background" and "foreground". The allocation of individual graphics data to one or the other of those categories will depend in large part on the use that is contemplated with respect to that data in the display, particularly if the display is to be animated. In general, "background" data will relate to those aspects of the scene to be displayed which are relatively constant or immovable, whereas "foreground" data will relate to objects which may be manipulated or moved in the course of time. Because of the more permanent character of the "background" objects in the scene, they may be stored in and retrieved from memory by means of operations which take very little time, but which precisely because of that time-saving feature are subject to some correlation restrictions. By saving time in processing the data for "background" objects, more time is available for processing the "foreground" objects, where that time is required because shortcuts in storage and processing are incompatible with the expected manipulation of the images of those objects. In addition, all of the objects, whether "background" or "foreground", may be broken down or "fractured" into a series of individual object elements. Each of those object elements is individually stored in memory, from which it may be called up at any time simply by addressing the appropriate location. Thus, for example, if a given object element appears in more than one place on the screen, it still need only be stored in memory once; also, if an object is to be moved on the display screen so as to be shown in a different location, the storage of that object element in memory is not affected, since all that is required is to change the address for the positioning of that element on the overall display.

Accompanying this approach is the overlaying of images in the positive z-plane, previously referred to. The linked lists will assign to each object element, either in "background" or in "foreground", a certain priority of writing into the buffer memory, and that priority will correspond to the location of the object in the positive z-plane, with the insertion of data for a given object element at a given point in the display buffer taking precedence over any data that may have previously been written at that point. Moreover, "foreground" objects will have priority over "background" objects. Hence the line buffers may be written into randomly along their length, enabling the use of the linked list approach, even though those buffers are read out sequentially to correspond with the sequential scanning of pixels on a given line of the television display screen.

It will be noted that there is a basic philosophical approach common to many of these features, to wit, treating various aspects of the graphics display data—colors, object elements and the like—in a manner which will remain relatively constant throughout the display, thereby to provide more time for the handling of data in connection with changeable or otherwise more demanding object elements.

It is therefore a prime object of the present invention to devise a system to store and handle data about a scene which minimizes the time required to retrieve that data and produce a picture.

It is another object of the present invention to devise process and equipment to represent an image in storage and to facilitate the retrieving of a maximum amount of data to formation of an image of maximum detail from a minimum amount of stored data, all in a minimum amount of time.

It is another object of the present invention to devise method and apparatus which arranges graphics data, and which retrieves that data, in a way to facilitate manipulation and animation of the produced images.

It is a further object of the present invention to use a combination of storing data with respect to an object in terms of individual object elements and retrieving that data by means of linked lists defining the visible priorities of the object elements, in order to maximize the speed of retrieval of the data to produce images.

It is a further object of the present invention to facilitate the formation of complex detailed images in real time by subdividing the various portions of the scene to be reproduced into "background" and "foreground" categories and treating those two categories differently in terms of data storage and retrieval, the "background" data being handled in a more short-cut fashion than the "foreground" object data.

It is a still further object of the present invention to provide a graphics display system with the large number of colors necessary to produce an acceptable image, but to access those colors in accordance with a system restricting the number of colors available at different places in the overall display, thereby greatly to facilitate the handling of color data and thus greatly minimizing the time required to produce the desired images.

DETAILED DESCRIPTION OF THE INSTANT SYSTEM

To the accomplishment of the above, and to such objects as may hereinafter appear, the present invention relates to a system (method and apparatus) for forming a graphics display, as defined in the appended claims, and as described in this specification, taken together with the accompanying drawings, in which:

Figure 4:
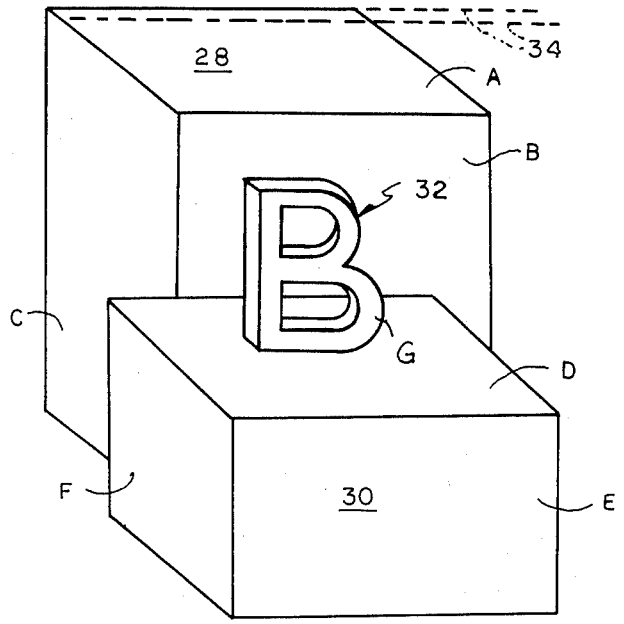
FIG. 4 is a representation of a particular arbitrary scene, chosen for purposes of explanation.
Figure 5:
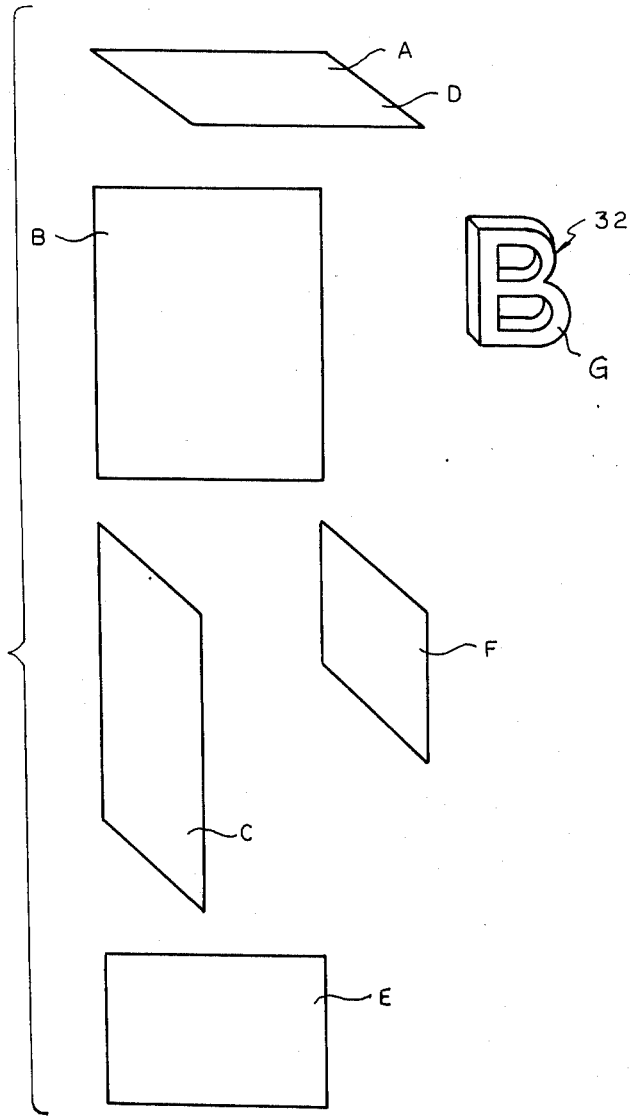
FIG. 5 is a view of the scene of FIG. 4 broken down or "fractured" into individual object elements.
Figure 7:
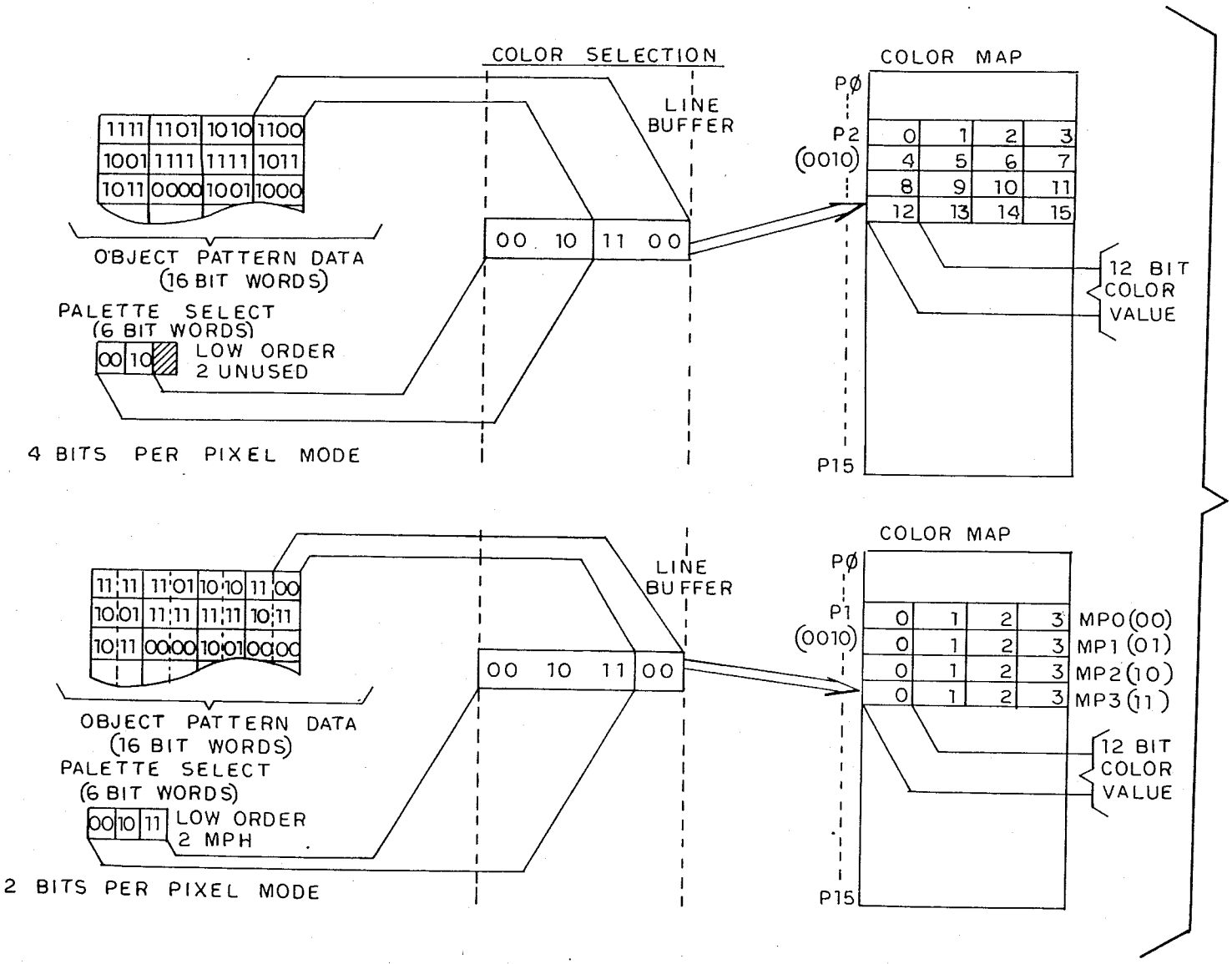
Figure 8:
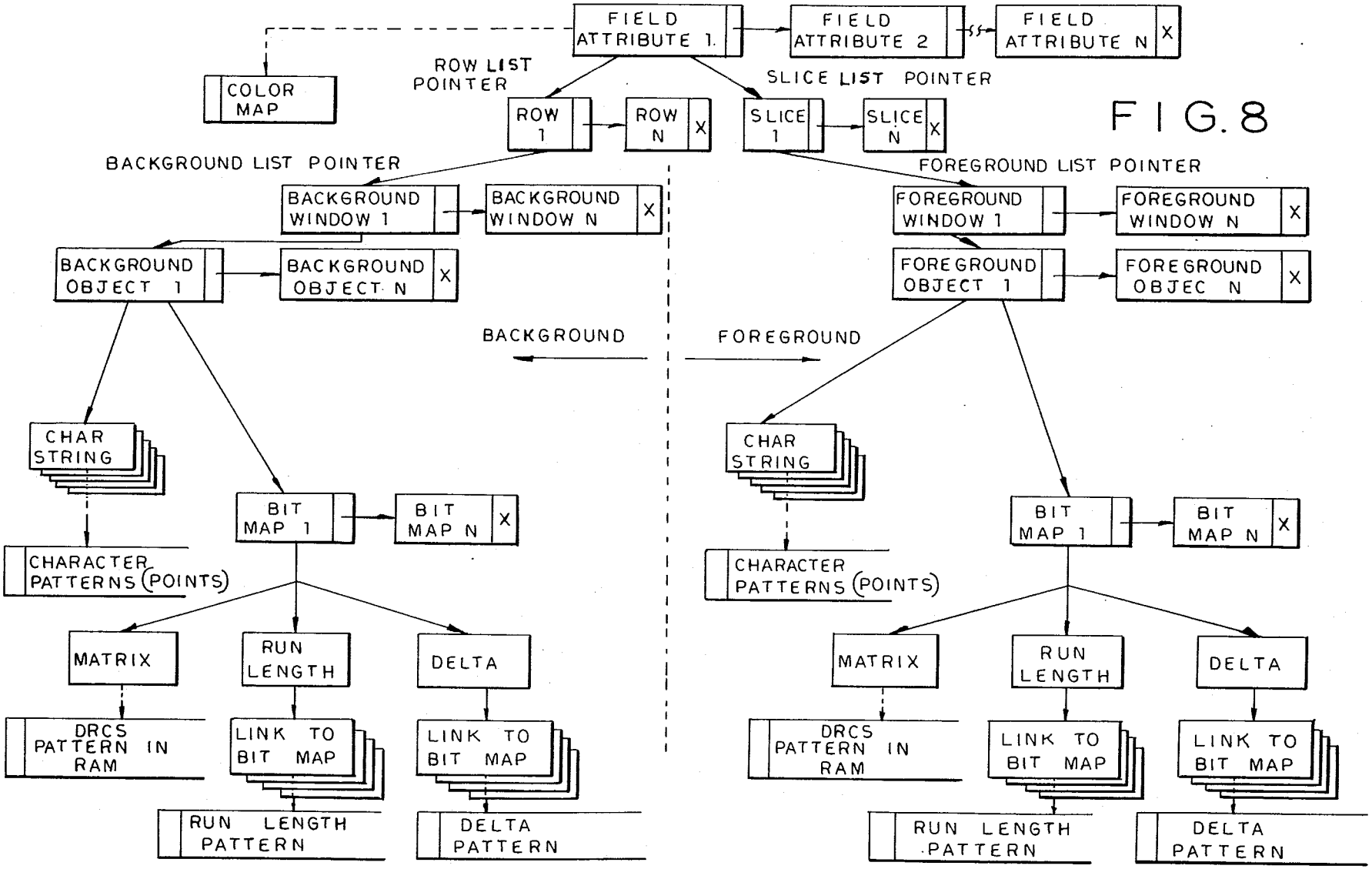
Figures 10, 11, 12:
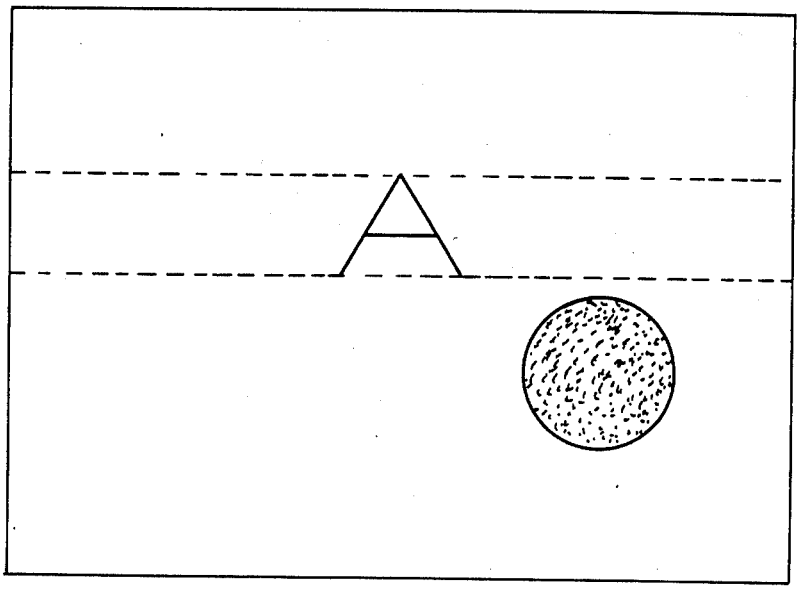
Figure 13:
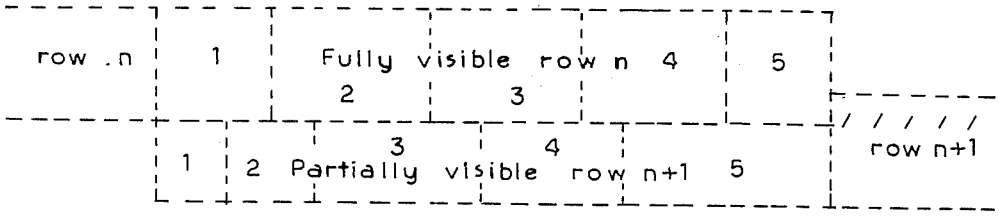
Figure 14:
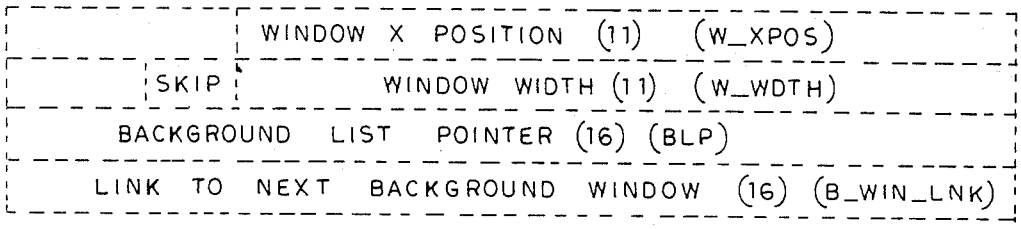
Figure 15:
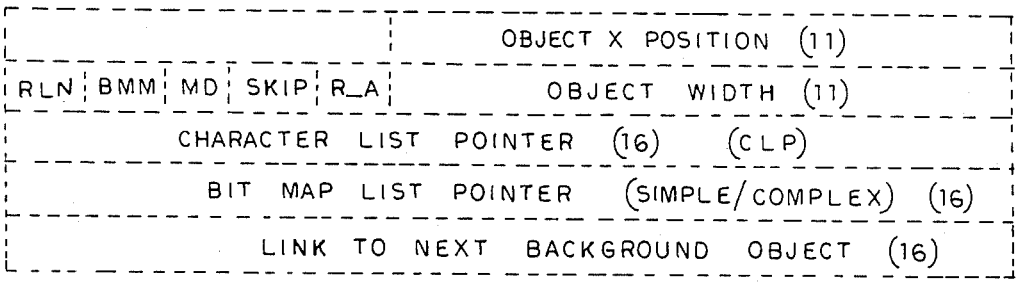
Figure 16:
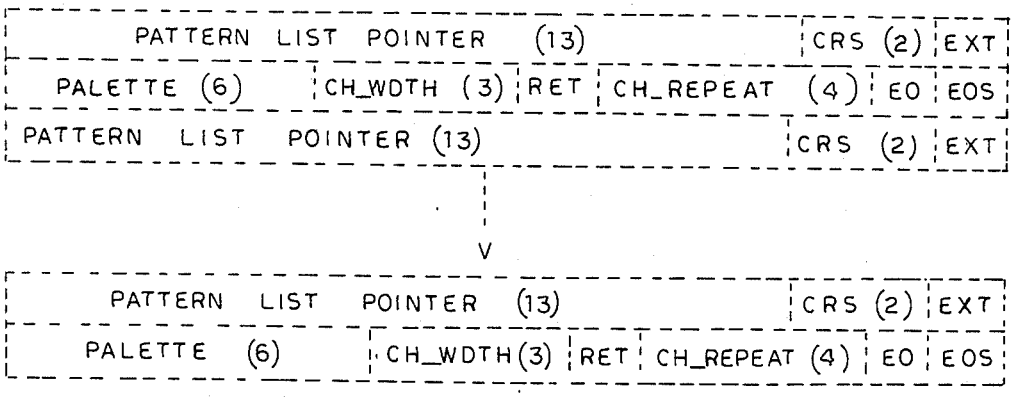
Figure 20:
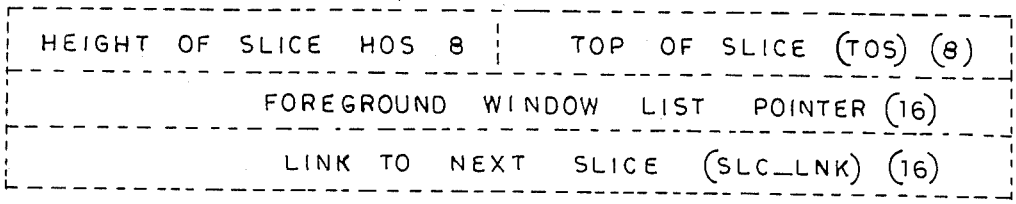
Figure 21:
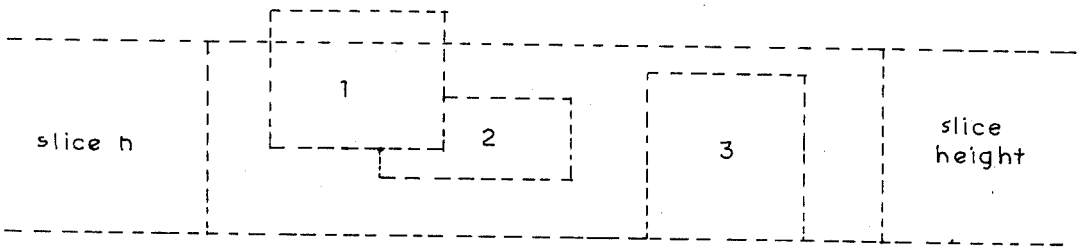
Figure 22:
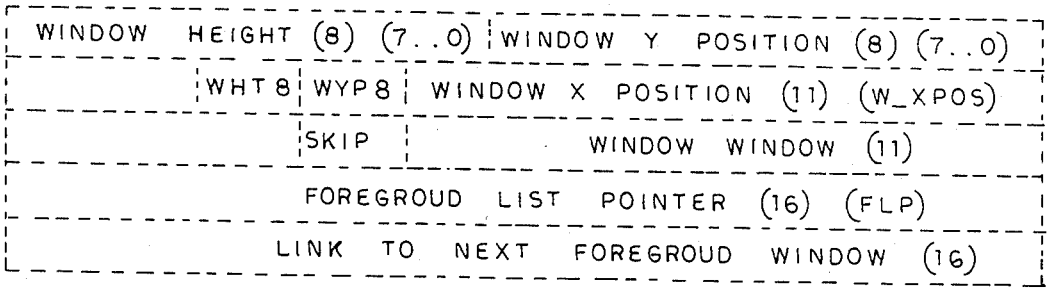

FIGS. *6a–6g* illustrate the various steps followed to produce the scene of FIG. 4 from the object elements of FIG. 5;

FIG. 7 is a diagramatic indication of two different ways in which color data is accessed and used;

FIG. 8 is a "tree" diagram illustrating the sequence of steps that are gone through, in accordance with the present system, in order to produce a display line from data with respect to "background" and "foreground" objects stored in memory;

FIG. *9a* is a pictorial representation of a shaded three-dimensional object;

FIG. *9b* is a pictorial planar representation of that portion of the object of FIG. *9a* included within the rectangle on that figure, with a limited number of different degrees of shading indicated;

FIG. *9c* is a 16-color palette that could be used with the representation of FIG. *9b* in order to produce a display image of said object with a pronounced three-dimensional appearance;

FIG. 10 is another arbitrary representation of a scene, used for explanatory purposes;

FIG. 11 is a diagram of a field attribute data block;

FIG. 12 is a diagram of a row attribute data block for "background" objects;

FIG. 13 is a diagramatic indication of the way in which rows may be used with respect to "background" objects, showing the relationship of a given row to the objects in that row;

FIG. 14 shows the data block for background window attributes;

FIG. 15 illustrates a data block for a background object;

FIG. 16 illustrates a data block for a background character;

FIG. 17 illustrates a data block for a background bit map string;

FIG. 18 illustrates one portion of a data block for run length encoding;

FIG. 19 illustrates another portion of the data block for run length encoding, indicating its cooperation with a linked list;

FIG. 20 illustrates a data block for a "foreground" slice;

FIG. 21 illustrates a "foreground" slice and the relationship of that slice to objects shown therein;

FIG. 22 illustrates a data block for a "foreground" window; and

Figure 23:
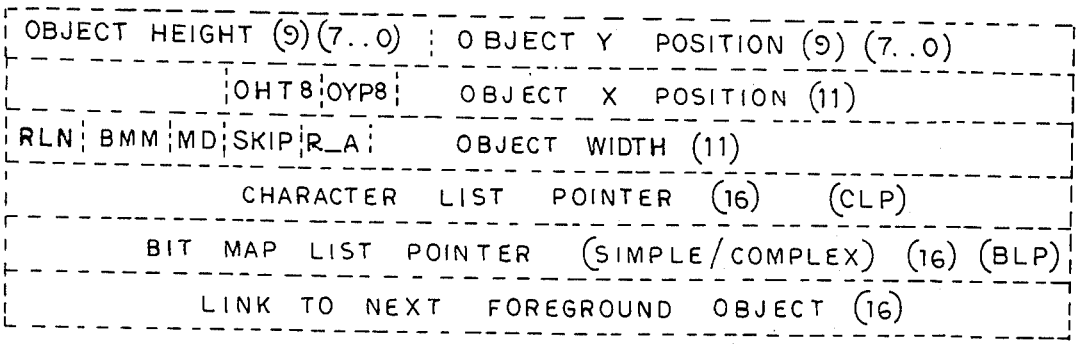

FIG. 23 illustrates a data block for a "foreground" object.

Figure 1:
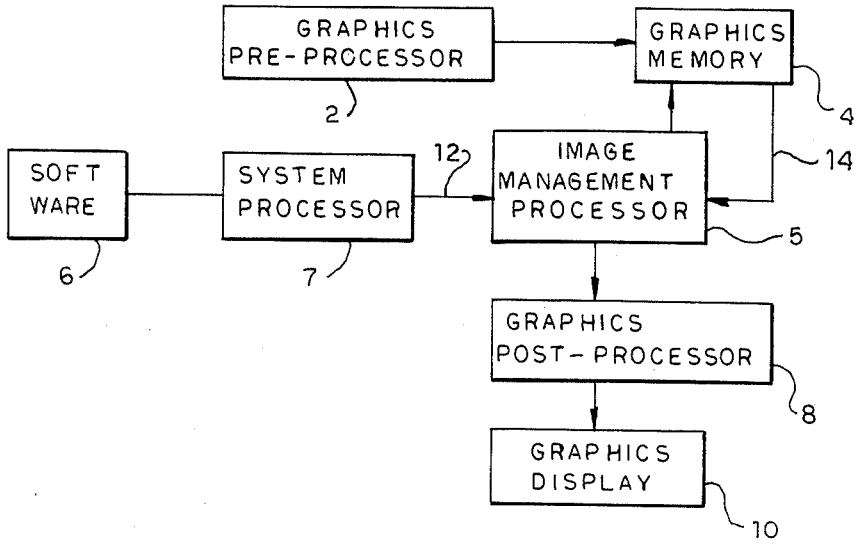
FIG. 1 is a simplified block diagram of the system of the present invention.

FIG. 1 is a block diagram showing the basic components of the system of the present invention. A graphics pre-processor 2 will convert the picture of the scene to be displayed into data stored at predetermined positions in the graphics memory 4. The image management processor 5, in conjunction with the instructions that it receives from software 6 via the system processor 7, will retrieve appropriate data from the graphics memory 4 and convert that data into a form which, after passing through the graphics post-processor 8, is fed to the graphics display 10, which may be a conventional TV picture tube, where a picture of the scene is formed and displayed. In many instances once the graphics pre-processor 2 has done its job, loading the graphics memory 4 with appropriate data, it is disconnected from the system, which thereafter functions on its own.

Figure 3:
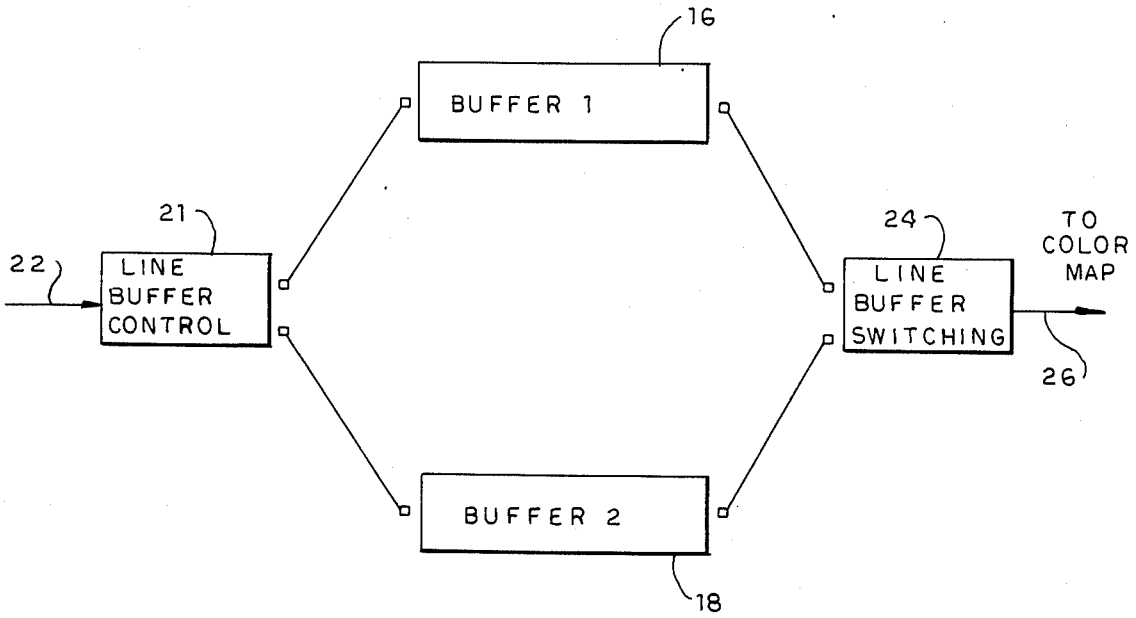
FIG. 3 is a block diagram showing the use of a pair of line buffers alternately as construction and display buffers.
Figure 2:
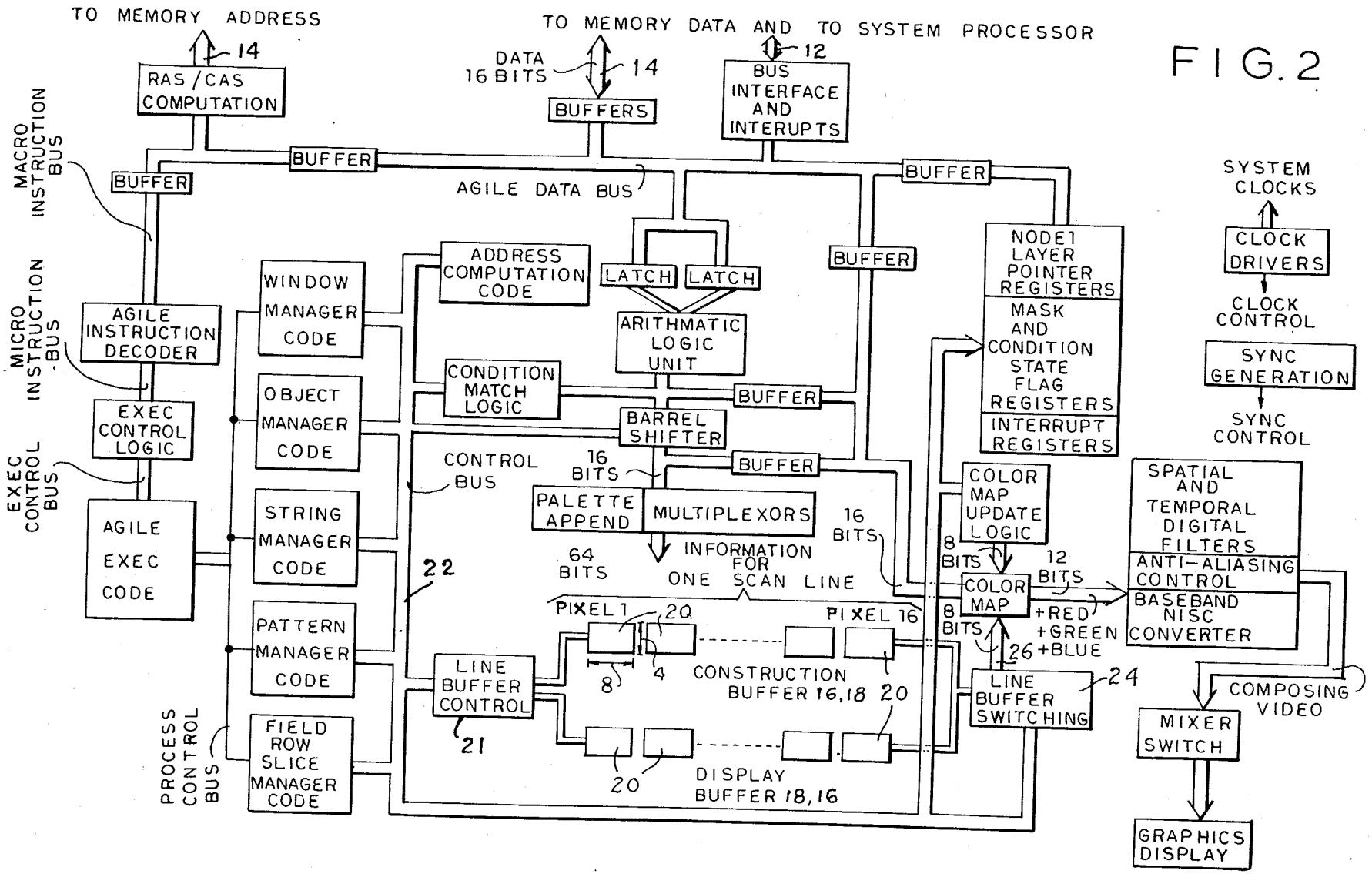
FIG. 2 is a more detailed block diagram of the hardware portion of the system.

FIG. 2 is a more detailed block diagram of the image management processor 5. The input thereto from the software 6 and system processor 7 is at 12. Its connection to the graphics memory 4 is shown at 14. It includes a pair of buffers 16 and 18 (see also FIG. 3) each of which comprises a plurality of data blocks 20 arranged (at least conceptually) in a line, each buffer 16 and 18 containing the same number of data blocks 20 as there are pixels in a display line in the graphics display 10. Thus each display block 20 in each of the buffers 16 and 18 corresponds to a particular pixel in each of the display lines of the graphics display 10. The length of time available between the beginning of the scan of one line on the graphics display 10 and the beginning of the scan of the display of the next line is very short, on the order of 64 microseconds. In order to enable this system to construct and display successive display lines within those time constraints, the two buffers 16 and 18 are used alternatively, with one being used to construct a line while the other is being used to actually display a line. The line buffer control 21 will connect one buffer, say the buffer 16, to the data input line 22, and will disconnect the buffer 18 therefrom, while at the same time the line buffer switching element 24 will connect the buffer 18 to the output line 26, while disconnecting the buffer 16 therefrom. That situation will continue while the graphics display 10 is scanning one line. When that scanning is completed the line buffer control 20 and the line buffer switching 24 will reverse their connections, so that during the next period of time the buffer 18 will be used for construction and the buffer 16 will be used for display. In this way sufficient time is provided to write data into all of the data blocks 20 alternatively in each of the buffers 16 and 18.

One of the features of the present system is the storing of data for the scene in terms of object elements, that is to say, the separate individual portions of the objects in the scene as they are viewed. The objects are "fractured" into individual visible portions, those portions are individually stored in memory, and are retrieved from memory whenever the object of which they are a part is to be constructed. In order to illustrate this we have shown in FIG. 4 a scene comprising a cube 28, a parallelopiped 30 and a three-dimensional representation 32 of the letter B. The width of the parallelopiped 30 is the same as the width of the cube 28. As indicated in FIG. 4, the scene there shown may be "fractured" into seven object elements A–G, of which object elements A and D are the same, so that only six object elements need be stored. Each of the individual objects in the scene is composed of separate surfaces. A cube or a parallelopiped has six surfaces, but in the particular picture here shown there are only three surfaces visible, so data with respect only to those three surfaces need be stored in memory. FIG. 5 illustrates the object elements in question, each set off separately, as they would be in memory.

FIGS. 6*a* through 6*g* illustrate how the object elements of FIG. 5 would be used to create the overall scene, the object element being written in in each individual figure being shaded. It will be understood that the scene is produced on the graphics display 10 as a series of display lines, and the data corresponding to the appropriate portion of an object element on a given display line will be inserted into the appropriate data blocks 20 along the length of whichever one of the buffers 16 or 18 is functioning as a construction buffer for that particular display line. This is indicated by the broken lines 34 on FIG. 4, which represent a particular display line on the graphics display 10. This explanation, for purposes of clarity, will ignore the line-by-line construction process.

It will be noted that the object elements as shown in FIG. 5 represent the surfaces of the object in question which would be visible in the absence of all other objects. Thus at the stage of FIG. 6*c* a cube 28, most remote from the viewer, is completely constructed, but when, in FIGS. 6*d*–6*f*, the parallelopiped 30 is constructed, it blocks out (erases) some of the representation of the cube 28. Similarly, as the letter B, designated by the reference numeral 32, is inserted into the scene, portions of the cube and parallelopiped behind that letter are likewise erased.

It is also very desirable, in order to facilitate and speed up data handling, to make certain distinctions between "background" and "foreground" objects. Those distinctions will be made on the basis of appropriate graphics criteria. In general, "foreground" objects will be those where animation or movement is expected, while "background" objects will, it is expected, change, or move, very little. Because of the more stable nature of "background" objects, they can be stored in memory and handled with greater facility, while detailed handling, requiring more data and hence more processing time, is reserved for those objects which require it.

Background objects are stored in memory in what are called "rows". (See FIG. 13) The height of a given row (the number of adjacent display lines that make up the row) will vary from scene to scene. A row may be only one display line high, it may take up the entire screen, or anyplace in between, depending upon the particular scene being portrayed. Rows are made up of "background" objects, and data storage and handling is facilitated by restricting background objects to the height of the row in which they appear. Background objects may overlap each other within a row along the x-axis, but not the y-axis.

For handling "foreground" objects, "slices" are employed. (See FIG. 21) A "slice", like a "row", may have any height, depending upon the particular scene involved. Rows are independent of slices and slices need not fall exactly on one row. Foreground objects need not fill the full height of the slice, and may overlap along both the x- and y-axes.

One of the most time-consuming aspects of creating a graphics display in color is selecting the particular color for each of the pixels on the display screen. In order for a color representation to be commercially acceptable, a truly large number of colors must be available. In our system 4096 colors are available. This produces quite acceptable color quality, but if one had to retrieve from memory, for each pixel on a display line, the particular one of those 4,096 colors that was desired, the data handling involved could not be carried out in real time by any data processor presently known which would be economically and spatially practical. To solve this problem, we have adopted a color selection system based on the premise that in individual sub-areas of the display screen the need for different colors is much more restricted than what is called for when the entire display screen is involved. There will be areas, sometimes small and sometimes large, where only a few different colors will be required, and it is wasteful of time, here a most precious commodity, to make a full color palette available where almost all of that palette will not be needed.

In our system the color is defined by a 12 bit word, four bits defining the red component of the color, four bits defining the green component and four bits defining the blue component. It is these twelve bits which permit defining 4096 different colors. However, when one uses buffers 18 and 20 with 8 bits per pixel, to construct those buffers one can choose from only 256 of those colors (see FIG. 7, a color map comprising a sequential list of 256 colors, each defined by a 12 bit value). The system can be operated in such an 8 bit mode. However, to make the color list easier to work with, and more memory efficient, it is segmented into a series of 16 "color palettes". Each palette holds 16 colors, arbitrarily selected by the operator for the particular graphics task at hand. Each palette is numbered, and each of the colors in a given palette is numbered. In order to use one of the 256 colors stored in the palettes, one must first specify the palette that is desired, and then the actual number of the color in that palette to be used in painting an object is supplied by the object description stored in memory 4. That description is in the form of an 8 bit word defining the address of the color, and when that address is interrogated a 12 bit word is found which defines the particular one of the 4096 colors that is involved.

For further flexibility, the system provides that, in displaying objects, the user has a choice of yet another mode—2 bits per pixel. The mode defines the color resolution of the object. Using 8 bits per pixel one can use any or all of the 256 colors in defining an object. Using 4 bits per pixel lets one use one of 16 colors to define a pixel. Using 2 bits per pixel causes the pattern data to be read in groups of 2 bits and only gives one a choice of 4 colors to describe a pixel.

The system, in order to conserve internal memory, makes some basic assumptions about the way people use color to paint pictures. One of these assumptions says that 90 percent of the time one will be able to paint an entire object without needing a color your palette doesn't contain. As a result, only one color palette may be used to create an object. More complex objects, having more colors, are able to be created by overlaying objects on top of each other. This allows one final new object to be composed of as many colors as one desires. With this in mind the two efficient color resolution modes take on new meaning. One must decide whether you will need to use more than 4 or less than 4 colors within an object, keeping in mind that having 16 colors readily available uses a lot of memory.

If, and only if, the 2 bits per pixel mode is in use, each of the 16 color palettes are further subdivided into 4 "mini-palettes". Each mini-palette contains 4 colors. Since the list of 256 colors is still logically divided into the 16 color palettes, the correct way to reference a mini-palette is to first specify the color palette, then specify the mini-palette.

The actual process of constructing the 8 bit word defining the color for a given pixel begins with the selection of the color resolution mode. Color resolution is specified within an object when its character and/or bit map strings are defined.

Once a mode is chosen, the "palette select" argument addressing the palette you want to use must be filled in. If the 4 bit mode is selected one need only specify one of the 16 color palettes. The 4 bits representing the color palette number are placed in the high order 4 bits of the 6 bit word (the remaining 2 low order bits are not used in the 4 bit mode). If the 2 bit mode is selected, one must specify one of the 4 mini-palettes in addition to the color palette. The 2 bits representing the mini-palette number are placed in the lowest 2 bits of the 6 bit word.

If the 8 bit mode was selected the palette address argument is ignored.

All of the components needed to display the object are now present and actual construction of the 8 bit line buffer word can begin.

In 4 bit mode, the first 4 bits are read from the object pattern data and deposited in the lower order 4 bits of the 8 bit word. The upper 4 bits of the 6 bit "palette select" word are then placed in the high order 4 bits of the 8 bit word. With the 8 bit word now filled on the line buffer, one pixel is completely specified as to choice of colormap selection. The system uses this colormap address (the 8 bit word) and displays the color associated with the 12 bit value it finds there.

In 2 bit mode, the first 2 bits are read from the object pattern data and deposited in the low order 2 bits of the 8 bit word. The entire 6 bit "palette select" word is then placed in the high order 6 bits of the 8 bit word. With the 8 bit word filled, one pixel is ready to be colored in. The system looks at the colormap address (the 8 bit word) and displays the color associated with the 12 bit value it finds there. Note that in 2 bit mode, one colors twice as many pixels as 4 bit mode for each fetch of object pattern data.

Although this method of addressing 4096 colors is indirect and seemingly complex, in fact it enables the system to provide the greatest amount of colors using the least amount of memory.

In 8 bit mode, the pattern data supplies all 8 bits required to completely define the color choice of one pixel. With the 8 bit buffer word filled the system uses this word, as before, to address the colormap and display the actual pixel color specified via the 12 bit value found there.

Figure 9A:
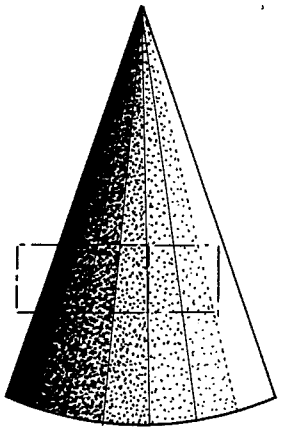

FIGS. 9A, B and C illustrate how the system supports the visual perception of a two-dimensional representation of a three-dimensional image.

Figure 9B:
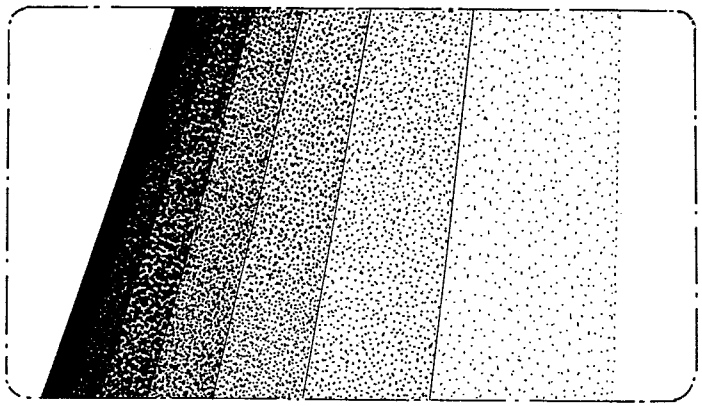
Figure 9C:
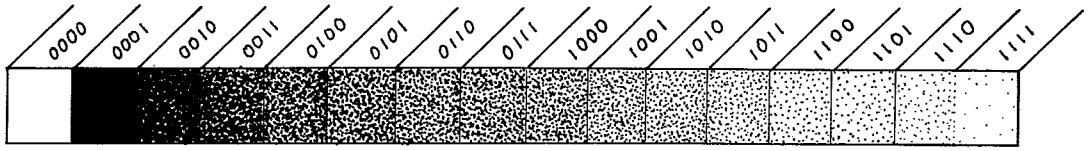

Using a four bit per pixel mode by way of example, a close coupling is achieved between the luminance grading of the selected color palette and the binary coding of the object pattern as defined in the system memory. In this example, the visual perceived effect is that of a cone illuminated from the right, and the rectangle in FIG. 9A represents a selected portion of the image. FIG. 9B is an expansion of that selected image portion showing certain arbitrary luminance shadings (dark to light), it being assumed for purposes of this example that the cone is of a single basic color. FIG. 9C is an illustration of the contents of the color map for the given example relative to the luminance values to be employed. The address "0000" represents transparency and the addresses from "0001" to "1111" represent gradations in shading from the darkest representation to the lightest representation. FIG. 9B may be considered as a unit screen bit map, with the individual bits having color definitions corresponding to the shading in FIG. 9B and the particular colors in FIG. 9C. It should be understood that while this particular example has been described in terms of gradations in a single color, the cone being postulated as a monochromatic object the polychromatic aspects of which arise from its illumination and the way in which it is seen, multi-colored objects could have two-dimensional representations producing comparable three-dimensional effects by using appropriate different colors in the palette of FIG. 9C. If more than 16 individual colors are thought to be required to produce a given image, the object may be represented in memory as a plurality of object elements, each with its own 16 color palette, the object elements being appropriately spatially related.

The system permits the display of character data as well as pictorial data, using known techniques. The system is also capable of providing windows—an area on the graphics display screen 10 on which an independent image may be displayed. Each window is in essence a variable-size virtual screen.

The sequence of steps performed by the system of the present invention, under the control of appropriate software, producing a graphics display is schematically indicated in FIG. 8, illustrating a linked list "tree" showing the procedure involved in connection with a given background (row) and foreground (slice) characteristic or attribute. A given line of a given image may involve a large number of row and slice attributes, the number being limited only by the time available to handle them. The software will produce real time display by traversing the tree structure, filling in appropriate nodes with information about the objects that are to be displayed, their positions relative to the screen and each other, and the pattern data to be used for the current representation of the image.

In considering the various stations or nodes in FIG. 8, reference should be made to FIGS. 11–23, which represent the data blocks at those nodes which contain the information appropriate to the action of the system when it comes to each of those nodes.

The FIELD ATTRIBUTE node is always the first node visited in the display of a picture. This node contains the start address of the picture and determines the type of display monitor being used (interlaced or non-interlaced). The domestic television usually uses an interlaced display pattern while a high resolution RGB (red, green, blue) monitor may use a non-interlaced display.

The data block for the FIELD ATTRIBUTE node (FIG. 11) is as follows:

[0000H=location zero in hexidecimal ]DISP-SEG (4 bits) (Display Segment)—This 4 bit location operates as an address extension and allows the system to support a 20 bit address reference.

EXRN V. TRAP (8 bits)(External Video Trap)—When the system is reproducing a picture, and if the EXV flag is set, this 8 bit trap value is continually tested against the 8 bit values contained in the pixel definition instruction buffer. The External Video Trap argument specifies an 8 bit value that describes an address into the colormap and as the system scans a picture, if this 8 bit TRAP value is encountered then the system is deactivated and some external video source colors the pixels on the screen. Upon recognition of a color that is different from the trap color, the system is again activated and the external video is turned off until the TRAP color is again encountered.

SCT (1 bit)(Scan Type)—Tells whether the monitor will use interlaced or a non-interlaced display.

LPN (1 bit)(Light Pen)—Tells whether a light pen will be active.

EXV (1 bit)(External Video)—Tells if some external video source will be used. If this flag is set then External Video Trap must be given an 8 bit value for a trap color.

SRS (1 bit)(Spacial Resolution)—Tells what the size of the Pixels on the screen will be. The choice here is 512 or 640 Pixels across the width of the screen.

ROW LIST POINTER (16 bits)—This is a pointer to the first node of Row Attributes. If the valve of the row list pointer is zero it indicates that "background" mode is disabled.

PALETTE UPDATE MASK (16 bits)—If any of the 16 palettes are to be changed, this 16 bit word will have 1's in those locations and the system will update those palettes.

COLORMAP BASE POINTER (16 bits)—A pointer to a colormap of 256 colors that are currently being used. This colormap area is shared between the system processor 7 and the image management processor 5.

Y ORIGIN—Sets the vertical position at which the first active line of the picture will begin.

X ORIGIN—Sets the horizontal location at which the first active pixel will be positioned. In effect, the x and y origins will position the first active pixel in the upper left hand corner of the display screen.

SLICE LIST POINTER—Points to the node that describes SLICE ATTRIBUTES.

The video graphics processor supports multiple background operating modes with an initial segregation being between a "character based" or a "bit map" area. The "background" mode organizes the display into a series of stacked horizontal rows. A row must be specified via its row attribute record, which includes information about the row height, any update of the color map for that row, a background window pointer, and a pointer indicating the link to the next row. The row information (FIG. 12) is composed of four words of sixteen bits each.

HEIGHT OF ROW (HOR)—The height of a row is a value referenced to the allocation of potential maximum image height for that row. The extent of any row visually displayed may be limited by being clipped by the bottom of a preceding row or being clipped by the bottom of the display area. The value is stored in the first 8 bits of the first 16 bit word of the Row Attribute data structure.

TOP OF ROW (TOR)—The upper boundary of the row is stored in the second 8 bits of the first 16 bit word of the data structure.

PALETTE UPDATE MASK—Stored as the second 16 bit word of the data structure, indicates any desired changes to the color map (containing 256 colors) for the row.

Note * An updated palette will affect any foreground objects as well as any background objects which reference a color choice within that palette.

BACKGROUND WINDOW LIST POINTER—Stored as the third 16 bit word and provides the address of the appropriate background window list.

LINK TO NEXT ROW—The last of the four words of the data structure points to the next row information. A NIL valve indicates "nothing left" or no remaining rows.

The top and height definitions provide strict boundaries for a row and define endpoints for the objects within that row; background objects are not permitted to exceed these boundaries. If row boundaries overlap, the row which appears first will have precedence over the following intersecting row(s) (See FIG. 13).

If there is to be a window which contains a background object(s), the start and the width of the window must be specified. The height of the window has been fixed to the height of the ROW. (For foreground objects, both the height and width of the window must be defined as well as the start position for the window itself.)

In the system windows will appear in the order defined through the linked list. That means that one can place one window on top of another window and cover part or all of the objects seen through the first window with objects referenced through the second. Defining windows in the system automatically clips off parts of the objects that fall outside of the window. For example: If a window is defined to be 8 by 6 pixels and an object that is 10 by 8 is to be shown in that window then two pixels across the bottom and two pixels down the side will be clipped off (assuming appropriate x and y coordinates have been chosen to position the object and the window x). This alleviates the problem of having the software decide which parts of the object belong in the window. The corresponding data block (FIG. 14) is as follows:

W-XPOS (11 bits)(window x position)—Defines what x coordinate the window is to begin at. [The window y position is defined by the top of the ROW]. (The window height is also defined by the height of the row.)

W-WDTH (11 bits)(window width)—Defines the width of the window.

BLP (16 bits)(background list pointer)—Points to the background object node.

NEXT (16 bits)—Points to the next BACKGROUND WINDOW NODE if one exists.

The background object node (FIG. 15) is as follows:

RLN (relinquish)—Momentarily interrupts the host system. A vector is passed back containing the address of the node (object) that caused the interrupt. This is useful when you want to see how a picture is being composed. (1 bit field).

BMM (bit map mode)—Set to "0", this indicates that the object you wish to display is composed of a "simple" bit map. A "1" indicates a "complex" bit map. (1 bit field).

A simple bit map has a fixed height that is equal to the height of either the object or the row. You can access only the vertical columns of the object.

A complex bit map has its height equal to the height of either the object or the row and allows you to access rows and columns of the object.

This gives greater flexibility in controlling the look of the object.

R-A (relative or absolute)—When set to "0" indicates that the starting co-ordinates of the object on the screen will be relative to the position of the last object displayed. When set to "1" indicates that the starting co-ordinates are absolute co-ordinates independent of previous object positions. (1 bit field).

OBJECT X POSITION—The x-axis offset of the object relative to either the left of the screen or the last object, depending on whether the R-A bit is set. (11 bit field).

OBJECT WIDTH—Given the row height as the height of the object and the object x position as the left boundary of the object, this specifies how much of the row's length should be dedicated to displaying the object. (11 bit field).

CHARACTER LIST POINTER—Points to the starting address of the character list that makes up the object. (16 bit field).

BIT MAP LIST POINTER—If BMM is set to simple (0) this points to the starting address of the list of bit map segments linked on the x-axis. If BMM is set to complex (1) this points to the address of the segment header and the starting address of the list of bit map segments. The segment header will divide the bit map into vertical elements, since it is already divided into columns. (16 bit field).

LINK TO NEXT—Points to the address of the next background object's tree structure, which will be similar to this. (16 bit field).

Characters may be used as components of objects. Characters are defined as having a maximum width of 16 pixels and a maximum height of either the row height (in the case of background objects) or the object height (in the case of foreground objects).

To make characters useful, and distinguishable from other primitive objects, the system assumes that they will be used in a manner similar to a typewriter. As a result, the characters defined within one object may not overlap each other and may be strung together to form a line of text (character string). The list is read until an "end of string" command is read.

FIG. 16 depicts the first, second, and last characters in this sequential listing. To describe the first character, you need to specify the first 2 16-bit fields. All succeeding characters may be defined by the third field ("pattern list pointer") only. The last character must consist of 2 16-bit fields, the first defining the character and the last denoting "end of string".

PATTERN LIST POINTER—A pointer to the address of the character you want to display. In giving the correct address you are actually specifying what style font and what character from that font you want. (13 bit field).

CRS (color resolution)—Specifies whether you want a color resolution of 2 bits ("00") or 4 bits ("01") or 8 bits ("10") per pixel. As mentioned earlier, this defines how many colors you will be able to use over an 8 pixel area (2 bits/pixel gives 4 color minipalettes and 4 bits/pixel gives 16 color palettes 8 bits/pixel gives direct access to all current 256 colors. (2 bit field).

EXT (extension word)—A flag to signify that this character is being described by a two word fetch. That informs the system that the next 16 bit word contains the extension information, not information about another character. It equals "1" if the extension word follows and "0" if it doesn't. (1 bit field).

PALETTE—Allows you to specify what color palette you want to use in coloring the following character string. The filling of this string depends on the color resolution chosen. As explained before, if 2 bit/pixel mode is set, then you must specify both a palette AND a mini-palette. The 4 bit/pixel mode only requires that a palette be specified. (6 bit field). The selection of 8 bit/pixel mode will cause the system to ignore the palette definition argument.

CH-WDTH (character width)—This lets you specify how wide the character is. The character may be up to 16 pixels wide. (3 bit field).

RET (return)—Allows you to break out of character mode when set to "1". This lets you leave the mode before the end of string flag. (1 bit field).

CH-REPEAT (character repeat)—Allows you to repeat the current character a maximum of 16 times. This saves you the overhead of searching memory up to 16 times in succession for the same character. (4 bit field).

EO (even/odd)—This informs whether or not the character is intended to be displayed as an interlaced object or not (naturally this only applies if the interlaced scan type has been chosen in the field attribute node). If EO is set to "1", the character will be traversed from top to bottom twice, once in this field and again in the next. On the first traversal only odd lines will be displayed. On the second traversal only the even lines will be displayed.

EOS (end of string)—Signifies the end of the string. Control is returned to the next object (foreground or background).

The BIT MAP STRING node determines how an object will be stored in memory. Object information can be stored in one of three ways (1) in a matrix representation, (2) RUN LENGTH ENCODED or (3) DELTA ENCODED.

In the matrix representation, objects are stored somewhere in memory in a unit screen bit map. When this object is to be drawn to the screen, the system points to the start address of the bit map and literally takes the whole bit map and copies it onto the screen.

Beginning with the start address for the object the information in memory is read directly to the line buffer which in turn places the image on the screen. As memory is read, if a location contains a 0 then no color is put in or a background color is put in. If a location contains another number then the corresponding color from the palette chosen will be put in that location.

The relevant data block (FIG. 17) is as follows:

PALETTE (6 bits)—Contains the palette from which the colors will be chosen.

BIT MAP WIDTH (10 bits)—The height of the bit map is defined by the foreground or background object. In this node we must define the width of the bit map. That is what this 10 bits describes.

RET (1 bit)(Return to Character String)—When this bit is set, it returns control from Bit Map Mode back to Character String Mode.

EO (1 bit)(Even Odd)—The pattern space is either packed for interlaced displays or is treated as separate even/odd spaces.

SKP (1 bit) (Skip)—Enables skipping to the next node without anything being written to the buffer. It automatically skips the position counter by the amount equal to the width.

FORMAT (2 bits)—Defines the format of the bit map construction and points to the node that contains this format. The construction can either be a Matrix construction, Run Length Encoded or Delta Encoded.

CRS (2 bit) (Color Resolution)—Use either 4, 16 or 256 color mode.

LINK TO NEXT BIT MAP STRING (16 bits)—The link to the next bit map node.

PATTERN LIST POINTER (16 bits)—Points to an area in memory that describes the RUN LENGTH ENCODED or DELTA ENCODED information. This data is indirectly indexed so that the same encoded commands can be repeated many times just by pointing to it over and over again.

The RUN LENGTH ENCODING node is activated when large sections of a scan line are all the same color. This node and the DELTA ENCODING node are different from the other nodes in that they do not send information directly to the line buffer. Instead, this information is "encoded" (information is given by commands) and it is this encoded information that paints the screen. By using encoding, we can paint large portions of the screen with just 16 bits (8 bits for REPEAT COUNT and 8 bits for REPEAT COLOR) instead of having to waste time and memory by filling the line buffer with the same information many times. The data block (FIG. 18) is as follows:

REPEAT COUNT (8 bits)—Contains the number of Pixels that are to be painted the same color.

REPEAT COLOR (8 bits)—Contains the color that is to be repeated.

DELTA ENCODING is used when colors in a line are to be shaded from one color to another color by very small changes (ramping). The DELTA mode allows the color to be ramped either by increments of −2, −1, 1, 2. Given the start color and the number of Pixels over which to ramp, the DELTA ENCODING will begin with the start color and read through the color map at the specified intervals and fill the Pixels with the appropriate color. Just as in RUN LENGTH ENCODING, this information is in command form. This saves time and memory by using one command to color many Pixels in a predictable pattern.

FIG. 19 illustrates what the pattern pointer of FIG. 17 does. If it points to a pattern, matrix representation ensues, as described above. If a run length encoded node is desired, it points to the appropriate link to run length for the appropriate line, and that line, in turn, points to appropriate color and length designations in memory. If run length line 1 and run length line 2 are to be the same, the links simply point to the same color/-length in memory. The pattern pointer could also point to appropriate data for the delta encoded mode.

When a row and its background objects have been created, control returns to the field attribute node to see if the row requires any foreground objects. If it does, the sequence proceeds down the foreground, or right-hand, side of FIG. 8. The foreground is made up of horizontal slices of the visible screen area. The user has complete control to specify the height of the slice and the physical location of the slice on the screen grid. The data structure of the slice attribute node for the construction of foreground objects is much like the row attribute node for background objects with the exception of the absence of the palette update mask. In a slice all areas not covered by particular objects remain unchanged. The data structure configuration for the slice attribute node is shown in FIG. 20, as follows:

HEIGHT OF SLICE (HOS)—This value is stored in the first 8 bits of the first 16 bit word of the data structure.

TOP OF SLICE (TOS)—This value is stored in the second 8 bits of the first 16 bit word of the data structure.

FOREGROUND WINDOW LIST POINTER—Stored as the second 16 bit word, this pointer will indicate the data that will construct the appropriate foreground window for that slice.

LINK TO NEXT SLICE—Stored as the last 16 bit word, information will point to the next slice or indicate NIL, interpreted as no slices remaining.

Slices may have their heights assigned regardless of the foreground objects height for that slice. Slices may not overlap but may butt together. Rows are independent of slices and slices need not fall exactly on one row.

Foreground windows are the same as background windows except that we must also define a window y position and a window height. (These two parameters were defined by the ROW in the BACKGROUND WINDOW NODE). The data block is shown in FIG. 22, as follows:

W-YPOS (9 bits) (window y position)—Defines the y coordinate for the window origin.

W-HGHT (9 bits) (window height)—Defines the height of the window.

WHT and WYP are the ninth or extension bits of W-YPOS and W-HGHT.

W-XPOS (11 bits) (window x position)—Defines the x coordinate for the window origin.

W-WDTH (11 bits) (window width)—Defines the width of the window.

FLP (16 bits) (foreground list pointer)—Points to the foreground object node if one exists.

NEXT (16 bits)—Points to the next FOREGROUND WINDOW NODE.

Foreground objects are generally the most visible and movable objects. Due to the nature of foreground objects, the system gives them greater flexibility than background objects. A foreground object is not restricted to the height of the slice that it inhabits. The object can be smaller than the slice without causing unwanted data to be displayed above or below it. The object can, therefore, overlap previously displayed objects along both the x-and y-axes. If, however, an object is taller than the slice it will be clipped to the dimensions of the slice (as seen before with background objects and rows).

The relevant data block is shown in FIG. 23, as follows:

OBJECT HEIGHT (9 bits)—Together with the object y position, this specifies how many pixels high the object will be. Specifically, this is used to specify the height boundary of the object.

OBJECT Y POSITION (9 bits)—This indicates the y coordinate to begin displaying the object at. Specifically, it defines the top boundary of the object.

OHT and OYP are the ninth or extension bits of OBJECT HEIGHT and OBJECT Y POSITION.

RLN (relinquish) (1 bit)—Momentarily interrupts the host system. A vector is passed back containing the address of the node (object) that caused the interrupt.

BMM (bit map mode) (1 bit)—Set to "0", this indicates that the object you wish to display is composed of a "simple" bit map. A "1" indicates a "complex" bit map.

MD—Defines character mode or bit map mode.

R-A (relative or absolute) (1 bit)—When set to "0" this indicates that the starting coordinates of the object on the screen will be relative to the position of the last object displayed. When set to "1" it indicates that the starting coordinates are absolute coordinates independent of previous object positions.

OBJECT X POSITION (11 bit)—This indicates the x coordinate at which to begin displaying the object. Specifically, it defines the left boundary of the object.

CHARACTER LIST POINTER (16 bit)—Points to the starting address of the character list that makes up the object.

BIT MAP LIST POINTER (16 bit)—If BMM is set to simple (0) this points to the starting address of the list of bit map segments linked on the x-axis. If BMM is set to complex (1) this points to the address of the segment header and the starting address of the list of bit map segments. The segment header will divide the bit map into rows, since it is already divided into columns.

LINK TO NEXT—Points to the address of the next foreground object's tree structure, which will be similar to this. (16 bit field).

Character attributes and bit map strings are treated the same whether they are foreground or background.

In order to more concretely explain how the system would work, let us consider the scene shown in FIG. 10. That scene has three objects in it the background color is object 1, the filled in circle is object 2 and the letter A is object 3. The background color and the circle are both considered background objects, while the "A" is a foreground object contained in the slice designated by the dotted line. The system tree would be traversed as follows in order to reproduce this image:

The FIELD ATTRIBUTE node is the start of the tree. In this particular example, the node tells us:

(1) external video will not be used
(2) the display is interlaced
(3) a light pen will not be used
(4) size of the pixels (spacial resolution)
(5) where to look for the first ROW
(7) x, y coordinate position of default screen window
(8) where to look for the first SLICE if indeed a slice does exist.

From the FIELD ATTRIBUTE node we travel down the left link to the ROW ATTRIBUTE node.

The ROW node tells us:

(1) that the top of the row is the top of the screen and the height of the row is the height of the screen
(2) if a palette must be updated this node tells us
(3) where to look for the first background window
(4) how to get to the next ROW node if there is one.

From the ROW mode we go to the BACKGROUND WINDOW NODE which tells us about window coordinates and dimensions and then we go to the BACKGROUND OBJECT NODE which tells us:

(1) BIT MAP STRING will be used first
(2) BIT MAP is simple
(3) pointer to BIT MAP NODE
(4) pointer to the next BACKGROUND OBJECT NODE From the BACKGROUND OBJECT NODE we go to the BIT MAP STRING NODE which tells us:

(1) (Palette) which color palette we will choose colors from
(2) (Bit Map Width) is the width of the screen
(3) (Format) that the data for this object is run length encoded
(4) (CRS) color resolution
(5) (Pattern List Pointer) points the information in memory which can be either run length, delta encoded or matrix
(6) (Link To Next) link to next BIT MAP NODE From the BIT MAP NODE we go to the RUN LENGTH NODE which tells us:

(1) (Link to run length segment) which points a location in memory that holds the encoded information
(2) at that location there are two words (1) REPEAT COUNT which is the number of pixels for which the color is to be repeated and (2) REPEAT COLOR which is the color to be repeated In our example, the color will be the color we choose as the background and it will be repeated for the width of the screen. This information is put into the construction buffer. Once the run length encoded information has been loaded into the buffer, we begin to backtrack up the tree.

We first go back to the BIT MAP STRING node and see if we have another run length to access in this line or if we must get a CHARACTER STRING or write to the buffer with DELTA encoded information. In our example, there is nothing else to do in the BIT MAP STRING node, so we go back up to the BACKGROUND OBJECT node.

At this node the system checks to see if there is an other background object in this scan. If one does exist, the system will read back down the links and write to the construction buffer over the information already at the locations where background object 2 is present. In our case, here is no other background object in the first line so we back up again to the WINDOW node and then to ROW node.

At this point, we find that we are still inside ROW 1 and all the background windows and their referened objects in this line have been sent to the buffer, so we go up to the FIELD ATTRIBUTE nod. From here we check to see if a SLICE is active. In our case, no SLICE is active at this line so the construction buffer is completed and is ready to be sent to the screen.

This traversal of the tree will be repeated display row by display row until the line that begins the slice that contains the letter A is reached.

At this point, the SLICE becomes active. This means that for those display rows after the background objects have been loaded into the buffer and the pointers trace back up to the FIELD ATTRIBUTE, we now traverse down the right branch of the tree to the SLICE node. From the SLICE node we go to the FOREGROUND WINDOW node and then to the FOREGROUND OBJECT node which determines that the letter A is a character, so we go down the link to the CHARACTER STRING node. The CHARACTER STRING node has a pointer to a location in memory that describes the letter A and loads the construction buffer with this information. Once the information for the A in each line is complete, we read back up to the FOREGROUND OBJECT node to see if there are any other objects in this line. In our example, there are none so we go up to FOREGROUND WINDOW node and then to SLICE ATTRIBUTE and up to FIELD ATTRIBUTE at which point the construction is complete.

This continues until the SLICE is no longer active. Thereafter, only the left half of the tree is active since only the two background objects (the background color and the filled in circle) are left to be displayed. We now read down the left side of the tree from FIELD ATTRIBUTE to ROW ATTRIBUTE to BACKGROUND WINDOW to BACKGROUND OBJECT to BIT MAP STRING at which point we decide if we are describing the background color or the circle. If we describe the background, we go to RUN LENGTH; otherwise, we go to matrix since the circle is stored as a dynamically redefinable character set. When the circle is completed the rest of the screen is RUN LENGTH encoded with the background color and the picture has been completed.

As will be seen from the above, the data defining the shapes and colors of the elements of even a complex scene are stored and handled in such a manner that the scene can, in real time, not only be displayed but also manipulated. Through judicious assignment of scene elements to "background" or "foreground", with specifically different memory and display treatment for each, through judicious selection of a limited number of particular colors to make up a palette for particular areas of the screen, through constructing a display line by writing randomly in the order of visible priority, and with one line being constructed while the preceding line is being displayed, and through other data storage and manipulation techniques, animation and display are achieved by means of memory circuitry and software that are economically practical for commercial graphics display systems. The system of the present invention enable state of the art software, microprocessors and memory to produce real time graphic displays of much greater complexity and sophistication, which are much more readily animated, than has previously been attainable except perhaps with large, and hence often commercially impractical, computers.

While but a single embodiment of the present invention has been here specifically disclosed, it will be apparent that many variations may be made therein, all within the spirit of the invention as defined in the following claims.

We claim:

1. A method for creating is a display device an image including a plurality of object elements, comprising the steps of:

(a) storing data corresponding to visual representations of said object elements;

(b) creating a list of at least some of said object elements, said list having an ordering of the object elements listed therein which corresponds to the visible priority ordering of the listed object elements in an image to be displayed;

(c) creating a line or lines of said image from said list and said data as follows:

(i) assembling a given line or lines of the image by placing in a memory an appropriate line or lines from the data of each object element which appears in the given line or lines of the image, said each object elements being taken in order from lowest to highest order in said list, with the data for each said object element being inserted in said memory at a position corresponding to the position of the object element appearing on said given line or lines of the image, and said data which is inserted at locations of said memory previously occupied by lower ordered data superseding said lower ordered data at said previously occupied locations;

(ii) reading out the data in said memory to said display device; and (d) creating further line or lines of said image by repeating step (c) a number of times to obtain the image.

2. The method as defined by claim 1, wherein said display device has a characterisic frame scanning time, and wherein said steps (c) and (d) are carried out within said characteristic frame scanning time.

3. The method as defined by claim 1, wherein said memory is a buffer memory which includes two buffer memory portions, and wherein said two buffer memory portions are used simultaneously, with the assembling of step (c)(i) being performed using one of said buffer memory portions while the reading out of step (c) (ii) is performed using the other of the buffer memory portions, the buffer memory portions then reversing roles in alternating fashion.

4. The method as defined by claim 2, wherein said memory is a buffer memory which includes two buffer memory portions, and wherein said two buffer memory portions are used simultaneously, with the assembling of step (c)(i) being performed using one of said buffer memory portions while the reading out of step (ii) is performed using the other of the buffer memory portions, the buffer memory portions then reversing roles in alternating fashion.

5. The method as defined by claim 1, wherein said steps (c) and (d) respectively comprise creating a line and further lines of said image.

6. The method as defined by claim 1, wherein said list of at least some of said object elements is a linked list.

7. The method as defined by claim 2, wherein said list of at least some of said object elements is a linked list.

8. The method as defined by claim 5, wherein said list of at least some of said object elements is a linked list.

9. The method as defined by claim 1, wherein each item in said list of object elements further includes, for each object element, information concerning the location of the object element in the stored data and the position of the object element in the image, and wherein said step (c)(i) includes fetching the appropriate line or lines of each object element in response to the particular line or lines being assembled, the object location in the stored data, and the object position in the image.

10. The method as defined by claim 2, wherein each item in said list of object elements further includes, for each object element, information concerning the location of the object element in the stored data and the position of the object element in the image and wherein said step (c)(i) includes fetching the appropriate line or lines of each object element in response to the particular line or lines being assembled, the object location in the stored data, and the object position in the image.

11. The method as defined by claim 3, wherein each item in said list of object elements further includes, for each object element, information concerning the location of the object element in the stored data and the position of the object element in the image and wherein said step (c)(i) includes fetching the appropriate line or lines of each object element in response to the particular line or lines being assembled, the object location in the stored data, and the object position in the image.

12. The method as defined by claim 5, wherein each item in said list of object elements further includes, for each object element, information concerning the location of the object element in the stored data and the position of the object element in the image and wherein said step (c)(i) includes fetching the appropriate line or lines of each object element in response to the particular line or lines being assembled, the object location in the stored data, and the object position in the image.

13. The method as defined by claim 6, wherein each item in said list of object elements further includes, for each object element, information concerning the location of the object element in the stored data and the position of the object element in the image and wherein said step (c)(i) includes fetching the appropriate line or lines of each object element in response to the particular line or lines being assembled, the object location in the stored data, and the object position in the image.

14. The method as defined by claim 1, wherein the data for the object elements is stored in a form having a color value associated with each picture element of each stored object element and wherin said list of object elements also includes, for each object element in the list, a color palette selection code and wherein the step (c)(ii) of reading out a line or lines of information from the buffer memory to the display device includes reading said values to said display device via color look-up table, the color values associated with the look-up table being determined, for each object, by said color palette selection code.

15. The method as defined by claim 2, wherein the data for the object elements is stored in a form having a color value associated with each picture element of each stored object element and wherein said list of object elements also includes, for each object element in the list, a color palette selection code and wherein the step (c)(ii) of reading out a line or lines of information from the buffer memory to the display device includes reading said values to said display device via a color look-up table, the color values associated with the look-up table being determined, for each object, by said color palette selection code.

16. The method as defined by claim 4, wherein the data for the object elements is stored in a form having a color value associated with each picture element of each stored object element and wherein said list of object elements also includes, for each object element in the list, a color palette selection code and wherein the step (c)(ii) of reading out a line or lines of information from the buffer memory to the display device includes reading said values to said display device via color look-up table, the color values associated with the look-up table being determined, for each object, by said color palette selection code.

17. The method as defined by claim 5, wherein the data for the object elements is stored in a form having a color value associated with each picture element of each stored object element and wherein said list of object elements also includes, for each object element in the list, a color palette selection code and wherein the step (c)(ii) of reading out a line or lines of information from the buffer memory to the display device includes reading said values to said display device via a color look-up table, the color values associated with the look-up table being determined, for each object, by said color palette selection code.

18. The method as defined by claim 7, wherein the data for the object elements is stored in a form having a color value associated with each picture element of each stored object element and wherein said list of object elements also includes, for each object element in the list, a color palette selection code and wherein the step (c)(ii) of reading out a line or lines of information from the buffer memory to the display device includes reading said values to said display device via a color look-up table, the color values associated with the look-up table being determined, for each object, by said color palette selection code.

19. Apparatus for creating on a display device an image including a plurality of object elements, comprising:

(a) means for storing data corresponding to visual representations of said object elements;

(b) means for storing a list of at least some of said object elements, said list having an ordering of the object elements listed therein which corresponds to the visible priority ordering of the listed object elements in an image to be displayed;

(c) means for creating a line or lines of said image from said list and said data, including:

(i) means for assembling a given line or lines of the image by placing in a buffer memory an appropriate line or lines from the data of each object element which appears in the given line or lines of the image, said each object elements being taken in order from lowest to highest order in said list, with the data for each said object element being inserted in said buffer memory at a position corresponding to the position of the object element appearing on said given line or lines of the image, and said data which is inserted at locations of said buffer memory previously ocuppied by lower ordered data superseding said lower ordered data at said previously occupied locations;

(ii) means for reading out the data in said buffer memory to said display device;

(d) means for creating further line or lines of said image by causing said means (c) to repeat its operation a number of times to obtain the image.

20. Apparatus as defined by claim 19, wherein said buffer memory comprises two parallel-in-serial-out buffer memory portions which are used simultaneously, one of said buffer memory portions being used to assemble a given line or lines of the image while the other is reading out a previously assembled line or lines of the image, and means for reversing the roles of said buffer memory portions.

21. Apparatus as defined by claim 19, wherein said means for storing data corresponding to visual representations comprises a random access memory for storing bit map patterns representative of said object elements.

22. Apparatus as defined by claim 20, wherein said means for storing data corresponding to visual representations comprises a random access memory for storing bit map patterns representative of said object elements.

23. Apparatus as defined by claim 20, wherein said buffer memory portions are each adapted to store one line of said image.

24. Apparatus as defined by claim 21, wherein said means for storing a list of at least some of said object elements is adapted to store, for each object element, information concerning the location of the object element in said random access memory and the position of the object element in the image.

25. Apparatus as defined by, claim 22, wherein said means for storing a list of at least some of said object elements is adapted to store, for each object element, information concerning the location of the object element in said random access memory and the position of the object element in the image.

26. Apparatus as defined by claim 19, wherein said means for storing data corresponding to visual representations of said object elements is adapted to store a color value for each picture element of each stored object element, and wherein said means for storing a list of at least some of said object elements is adapted to store, for each object element in the list, a color palette selection code, and wherein said means for reading out the data in said buffer memory to said display device includes a color look-up table, the color values associated with the look-up table being determined, for each object, by said color palette selection code.

27. Apparatus as defined by claim 20, wherein said means for storing data corresporling to visual representations of said object elements is adapted to store a color value for each picture element of each stored object element, and wherein said means or storing a list of at least some of said object elements is adapted to store, for each object element in the list, a color palette selection code, and wherein said means for reading out the data in said buffer memory to said display device includes a color look-up table, the color values associated with the look-up table being determined, for each object, by said color palette selection code.

28. Apparatus as defined by claim 23, wherein said means for storing data corresponding to visual representations of said object elements is adapted to store a color value for each picture element of each stored object element, and wherein said means for storing a list of at least some of said object elements is adapted to store, for each object element in the list, a color palette selection code, and wherein said means for reading out the data in said buffer memory to said display device includes a color look-up table, the color values associated with the look-up table being determined, for each object, by said color palette selection code.

29. Apparatus as defined by claim 24, wherein said means for storing data corresporling to visual representations of said object elements is adapted to store a color value for each picture element of each stored object element, and wherein said means for storing a list of at least some of said object element is adapted to store, for each object element in the list, a color palette selection code, and wherein said means for reading out the data in said buffer memory to said display device includes a color look-up table, the color values associated with the look-up table being determined, for each object, by said color palette selection code.

* * * * *

UNITED STATES PATENT AND TRADEMARK OFFICE

CERTIFICATE OF CORRECTION

PATENT NO. : 4,700,181

DATED : October 13, 1987

INVENTOR(S) : Maine et al.

It is certified that error appears in the above—identified patent and that said Letters Patent is hereby corrected as shown below:

Column 21, line 43 change "is" to --on--

Column 22, line 7 correct the spelling of "characteristic"

Column 24, line 30 correct the spelling of "occupied"

Column 24, line 65 after "by" delete the comma

Signed and Sealed this

Twenty-fourth Day of May, 1988

*Attest:*

DONALD J. QUIGG

*Attesting Officer*

*Commissioner of Patents and Trademarks*